US007067729B2

(12) United States Patent
Leong

(10) Patent No.: US 7,067,729 B2
(45) Date of Patent: Jun. 27, 2006

(54) PLECTRUM

(76) Inventor: Weng Onn Leong, 144 Tai Keng Gardens, Singapore 535424 (SG)

( * ) Notice: Subject to any disclaimer, the term of this patent is extended or adjusted under 35 U.S.C. 154(b) by 11 days.

(21) Appl. No.: 10/487,586

(22) PCT Filed: Dec. 21, 2001

(86) PCT No.: PCT/SG01/00258

§ 371 (c)(1),
(2), (4) Date: Feb. 24, 2004

(87) PCT Pub. No.: WO03/054851

PCT Pub. Date: Jul. 3, 2003

(65) Prior Publication Data

US 2004/0194607 A1 Oct. 7, 2004

(51) Int. Cl.
*G10D 3/16* (2006.01)

(52) U.S. Cl. ..... 84/322; 84/320

(58) Field of Classification Search ..... 84/322, 84/320, 321
See application file for complete search history.

(56) References Cited

U.S. PATENT DOCUMENTS

| | | | | |
|---|---|---|---|---|
| 2,459,274 A | * | 1/1949 | Galetzky | 84/320 |
| 3,312,137 A | | 4/1967 | Oddo | |
| 4,150,601 A | | 4/1979 | Henley, Jr. | |
| 4,625,615 A | | 12/1986 | Lukehart | |
| 4,993,301 A | | 2/1991 | De Los Santos | |
| 5,271,308 A | | 12/1993 | Balog | |

(Continued)

FOREIGN PATENT DOCUMENTS

| | | |
|---|---|---|
| FR | 22/76650 | 1/1976 |

(Continued)

OTHER PUBLICATIONS

European Search Report for EP Application No. 01275079.0 dated Mar. 18, 2005.

(Continued)

*Primary Examiner*—Marlon T. Fletcher
*Assistant Examiner*—Jianchun Qin
(74) *Attorney, Agent, or Firm*—Harness, Dickey & Pierce, P.L.C.

(57) ABSTRACT

The present invention relates to a plectrum (1) having two portions (10, 12) being offset transversely but connected integrally by a stepped member (14). One portion (12) may have a tear-drop shaped playing edge (112), while the other portion may have a pointed edge (114) at one corner and another short pointed edge (118) at the second corner. A scallop playing edge (116) is typically joined to the short pointed edge (118). The stepped edge (14) is preferably in the shape of an arc. Other embodiments of the present invention include a plectrum (1*a*, 1*b*, 1*c*, 1*d*) having a planar body (20) with a tear-drop shaped playing edge (112*a*, 112*b*, 112*c*, 112*d*), a pointed playing edge (114*a*, 114*b*, 114*c*, 114*d*) and a short pointed edge (118*a*, 118*b*, 118*c*, 118*d*). A scallop shaped edge (116*a*, 116*b*, 116*c*, 116*d*) may be joined to the short playing edge (118). On the faces of the plectrum is preferably a ridge (201), a groove (202) or a combination of a ridge (201) and a groove (202) on the same or opposed face. The ridge or groove is optionally disposed across the center of the plectrum and is in the form of an arc. The curved stepped edge (14) or the edges of the curved ridge (201) or groove (202) seek to provide a positive grip on the plectrum. The curved edges are also formed to fit comfortably with the curve of the user's thumb or finger.

19 Claims, 3 Drawing Sheets

U.S. PATENT DOCUMENTS

| | | | | |
|---|---|---|---|---|
| 5,341,715 | A | 8/1994 | Hucek et al. | |
| 5,594,189 | A | 1/1997 | Latteri | |
| 5,648,622 | A | 7/1997 | Storey et al. | |
| 6,008,442 | A | 12/1999 | Reidenbach et al. | |
| 6,342,661 | B1 * | 1/2002 | Flamm | 84/322 |

FOREIGN PATENT DOCUMENTS

| | | | |
|---|---|---|---|
| FR | 2721429 | A1 | 12/1995 |
| GB | 2355573 | A | 4/2001 |
| RU | 2119194 | | 9/1997 |
| WO | WO 00/23981 | | 4/2000 |

OTHER PUBLICATIONS

International Search Report for PCT/SG01/00258 mailed Feb. 19, 2002; ISA/AU.

Decision To Grant A Patent For Invention for corresponding RU Application 2004122416/12 (024202), Application filed Dec. 21, 2001, which provides results of examination of the Russian application (English translation included).

* cited by examiner

PLECTRUM

FIELD OF THE INVENTION

This invention relates to a plectrum for picking or strumming the strings of a musical instrument. In particular, it relates to a plectrum for holding between the thumb and finger.

BACKGROUND OF THE INVENTION

Plectrums, or picks, for a stringed instrument, such as a guitar, banjo, harp and the like, have long been used as an alternative to one's fingernails to pick or strum the strings. These plectrums are useful devices for a user who wishes to play a stringed instrument.

Typically, a user chooses a plectrum according to its characteristics, type of strings used on the instrument, and his style and technique of playing.

A common plectrum is a flat piece of material, which may be made from plastics, wood, bone, shell, metal or any other suitable material. Plastic plectrums have become very common in usage and its suitability for use with nylon strings further make them popular. Metal plectrums are hard and; rigid, and are mostly suitable for metal strings. These materials have their own characteristic stiffness and are used to produce different tones and texture of sounds.

Conventional plectrums are also made in various shapes. The typical shapes are triangular or oval (or melon-seed or tear-drop shapes). There are three factors that affect the characteristic sound a plectrum may produce: the gripping point between the thumb and finger; the distance of the playing edge from the gripping point; and the thickness at the playing edges.

The problem with a flat plectrum is the difficulty of having a good grip between the thumb and finger. This affects the accuracy of picking the individual strings of the musical instrument. To overcome this problem of providing a good grip, especially for a plastic moulded plectrum, the prior art has shown the use of knurling or texturing the gripping point. Another method is to provide an aperture at the gripping point. By providing a good grip on the plectrum, this enables the user to accurately pick the string to produce a particular note and allows him to express his style and technique of playing confidently.

The size of a plectrum is another factor. There is a trade off between the size and ease of gripping a plectrum. A large plectrum provides a larger gripping area but its size impedes the agile pivoting of the plectrum between the thumb and finger. On the other hand, the gripping area of a smaller plectrum is limited although the smaller size provides better dexterity to the user.

These conventional plectrums are commonly described as "thick", "medium" and "thin" with thickness of substantially 1, 0.7 and 0.5 mm respectively. For example, for use in playing a guitar, a "thick" plectrum produces louder and more powerful sounds, such as for solo or lead roles. A "thin" plectrum produces a gentle and soft sound, such as for acoustical background sound. The "medium" thick plectrum may be used for normal or common sounds.

A typical plectrum has a limited number of playing edges. A playing edge is often located at an end of the plectrum. When a variety of tones or sounds are required, the user is required to alternate between a number of playing edges available on a plectrum. Otherwise, he will have to change to a different plectrum whilst playing the instrument. This may be necessary when the user desires to produce sound texture, ranging from, for example, heavy-metal rock type to the soothing strum of the 12-string acoustic guitar.

The plectrum of this invention alms at overcoming or at least alleviate some of the above shortcomings or problems of conventional plectrums. An aim is to provide the user with control and variety in the generation of the tone and quality of a stringed musical instrument with the aid of a plectrum.

SUMMARY OF THE INVENTION

According to a first embodiment of the invention there is provided a plectrum for a stringed musical instrument. The plectrum comprises a first portion, a second portion and a connection member. The first portion has a plurality of string engaging means. The second portion has a further string engaging means. The connection member is integrally formed in the shape of an arc across the plectrum, connects the first and second portions, and provides a grip between a user's finger and thumb. The plurality of string engaging means and the further string engaging means are arranged to allow a user to nlav the stringed instrument by engaging one or more strings of the stringed instrument with one or more of the stringed engaging means.

Typically, the plectrum has a ridged or stepped member that is formed substantially across the centre of the plectrum. The ridged or stepped member may also be curved and project into the first portion.

Typically, the first and second portions of the plectrum are respectively flat members, with the first position in a raised position relative to the second portion.

Optionally, the first or second portions of the plectrum have at least one pointed string engaging edge, at least one jagged or scallop shaped string engaging edge, and at least one oval (or melon-seed or tear-drop) shaped string engaging edge.

Preferably, the first portion of the plectrum comprises a short pointed string engaging edge in close proximity with a jagged or scallop shaped edge.

Typically, the ridged or stepped member has at least one end being operable as a further string engaging edge.

According to a second embodiment of the invention, there is provided a plectrum for a stringed instrument having a first end and a second end. The plectrum comprises a first substantially flat member, a second substantially flat member, and a connection member. The first substantially flat member has a plurality of string engaging edges. The second substantially flat member has a further string engaging edge. The connection member is an integrally formed ridged or stepped member formed in an arc across the middle of the plectrum, connects the first and second members, and provides a grip between a user's thumb or finger. The plurality of string engaging edges and the further string engaging edge are arranged to allow the user to play the stringed instrument by engaging one or more strings of the stringed instrument with one or more of the string engaging edges.

Alternatively, in a third embodiment there is provided a plectrum for a stringed musical instrument. The plectrum comprises a first portion, a second portion and a connection member. The first portion has a plurality of string engaging means. The second portion has a further string engaging means. The connection member is integrally formed in the shape of a curved groove across the plectrum, connects the first and second portions, and provides a grip between a user's finger and thumb. The plurality of string engaging means and further string engaging means are arranged to allow a user to play the stringed instrument by engaging one or more strings of the stringed instrument with one or more of the string engaging means.

Alternatively, in a fourth embodiment of the invention there is provided a plectrum for a stringed musical instrument. The plectrum comprises a first portion, a second portion, and a connection member. The first portion has a plurality of string engaging means. The second portion has a further string engaging means. The connection is integrally formed in the shape of a curved ridge across a first face of the plectrum and a curved groove on a second opposed face of the plectrum, connects the first and second portions, and provides a grip between the user's finger and thumb. The plurality of string engaging means and further string engaging means are arranged to allow a user to play the stringed instrument by engaging one or more strings of the stringed instrument with one or more of the string engaging means.

Alternatively, in yet another embodiment there is provided a plectrum for a stringed musical instrument. The plectrum comprises a first portion, a second portion and a connection member. The first portion has a plurality of string engaging means. The second portion has a further string engaging means. The connection member is integrally formed in the shape of a combination curved ridge and groove extending substantially across at least one face of the plectrum, connects the first and second portions, and provides a grip between a user's finger and thumb. The plurality of string engaging means and the further string engaging means are arranged to allow a user to play the stringed instrument by engaging one or more strings of the stringed instrument with one or more of the string engaging means.

Alternatively, variations of a plectrum of this invention are provided, such as a mirror-image of each embodiment which is suitable for a left-handed user. Further, the arched ridge or groove may not extend across the entire width of the plectrum but formed from a number of discontinuous segments.

Typically, a plectrum of this invention is made from materials selected from the group consisting of plastics, metals, metal alloys and fibre glass.

BRIEF DESCRIPTION OF THE DRAWINGS

This invention will now be described by way of nonlimitative examples, with reference to the accompanying drawings, in which.

DESCRIPTION OF EMBODIMENTS OF THE INVENTION

Figure 1:
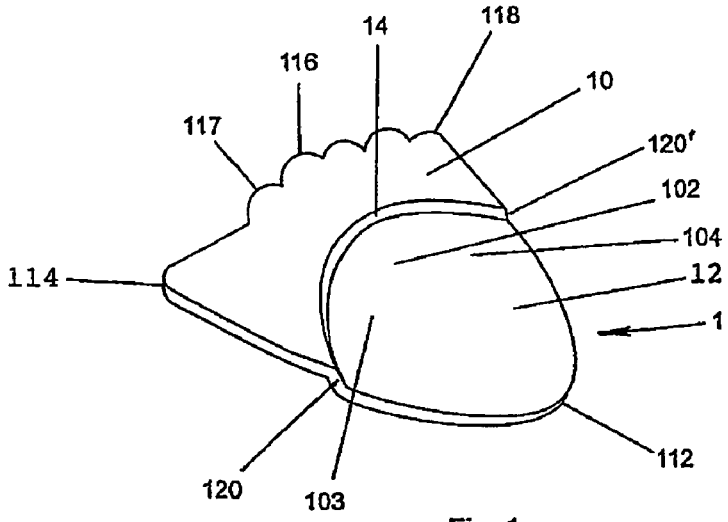
FIG. 1 illustrates a perspective view of a first embodiment of a plectrum in accordance with this invention.

Referring to the accompanying drawings, FIG. 1 shows a perspective view of a plectrum 1. The plectrum 1 comprises two portions 10 and 12, respectively. The two portions 10 and 12 are not coplanar but rather are offset transversely by a distance substantially the thickness of the plectrum 1. These two portions 10 and 12 are connected by an integrally formed step member 14. This step member 14 is in the shape of an arc, with the vertex of the arc extending into the first portion 10.

Portion 10 has two corners 114 and 118 opposed to each other, while portion 12 has an oval (or melon-seed or tear-drop) shape corner 112 distal from the other corners 114, 118. These corners define three of the playing edges 112, 114, 118 for engaging the strings of a musical instrument. However, further playing edges will be described below.

Playing edge 112 is oblong or oval shaped and has a rounded tip. This edge 112 is suitable for common play and is used for strumming and picking of individual strings, both in the up and down stroke movement. Pointed playing edge 114 is sharper than edge 112 and is suitable for fast picking. Edge 118 is another pointed edge like 114 but is joined up with a jagged or scallop shaped playing edge 116.

Figure 2:
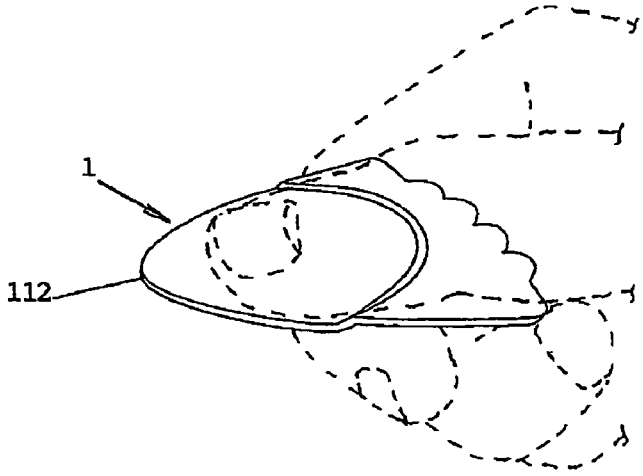
FIG. 2 illustrates a side view of the plectrum as shown in FIG. 1, in use, shown together with a thumb and finger.
Figure 3:
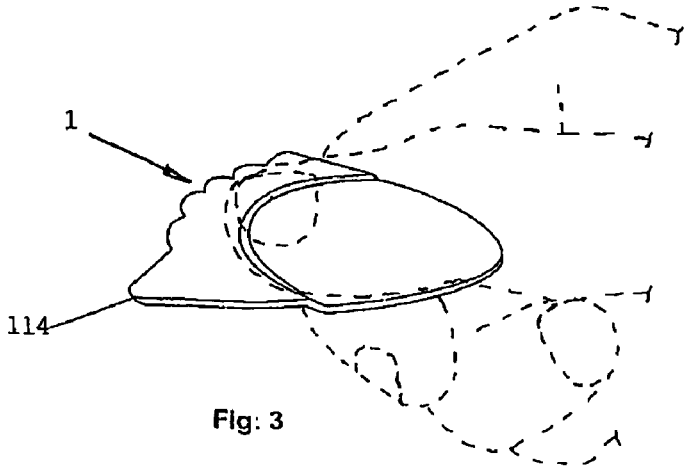
FIG. 3 illustrates another side view of the plectrum as shown in FIG. 1 being held between a thumb and finger.

The arched step 14 creates a recessed surface 102. When in use, for example edge 112 to engage the strings of a musical instrument, 102 defines the gripping area for the thumb and the corresponding area on the reverse side of plectrum 1 for the forefinger. At this gripping position, the curve at the back of the thumb's ball fits comfortably against the curved step 14 (as shown in FIG. 2). This curved step 14 provides the thumb a firm and positive grip on plectrum 1. Similarly, the curved step on the reverse side of plectrum 1 also provides the finger with a positive grip. With the provision of a firmer grip, the user is able to pivot the plectrum 1 between the thumb and finger easily each time he alternates between the upstroke and downstroke picking/strumming.

When using pointed edge 114 to engage the strings, the gripping area is located, for instance, at 103. The distance of edge 114 from gripping point 103 is shorter than that of 112 from 102. This makes corner 114 more stiff and, therefore, edge 114 is suitable for fast picking and produces louder sound, such as for solo play. At this gripping position 103, the front curve of the thumb fits with the curved step 14, which provides a positive grip for the thumb. Pointed playing edge 114 at this corner of plectrum 1 is also designed for edge 114 to be held at an ideal angle of 30 degrees with the strings for fast picking and also for producing dear intonations.

Scallop shaped edge 116 comprises at least three small curved edges 117. These constituent edges 117 form a convex profile to edge 116. When using this edge 116 for strumming the strings, each string is strummed more than once on each stroke and produces multiple sounds like that of a 12-strings guitar. Edge 116 is also used to produce a variety of strumming sounds, such as giving a more treble effect. Edge 116 provides good contact with the strings and is suitable for strumming both nylon and steel stringed instruments.

The scallop shaped edge 116 ends with a further pointed playing edge 118. Edges 116 and 118 are proximate to each other and provide a user a choice of strumming the strings with both edges 116, 118 or with only edge 118. By having a firm grip at position 104, for example, provided by the curve edge 14, a user is able to pivot the plectrum 1 about his thumb and finger and this gives him the freedom to combine the effect of edges 116 and 118 with relative ease. When edge 118 is strummed with the plectrum 1 at an angle with a string and at the same time allowing edge 116 to touch the string, an artificial muted harmonics is produced.

Step edge member 14 ends with a Z-profile on both sides of plectrum 1. The edges 120, 120' of the Z-profile is suitable for tugging the strings of a musical instrument. This provides an alternative to the practice of pinching the strings with one's fingers to produce a popping or slapping sound effect.

The surface at each of the gripping points 102, 103, 104 may have a concave depression or a convex protrusion to provide further grip for the thumb or finger.

With a choice of playing points 112, 114, 116, 118, 120, 120' to select from, plectrum 1 provides the user flexibility in playing a stringed instrument. Step edge 14 also provides a reference for a user to move his gripping point when different playing edges are alternately being used. This helps him to locate the precise playing points to use quickly and accurately. For example, after playing with edge 112, he can rotate plectrum 1 with his fingers and thumb and with the feel of step edge 14, move his gripping point to position 103, for example, and use playing edge 114 with relative ease and precision. This feature is especially helpful to the user for fast play.

Plectrum 1 of this invention also allows flexible control by holding the plectrum 1 between the thumb and finger, as compared to those that are worn on the thumb or finger. This allows the user to control the angle of inclination to the strings during the up-stroke or down-stroke picking/strumming. This also allows the user to pivot the plectrum 1 about the gripping point and thus relieves the finger of having to contort itself. The freedom of pivoting about the gripping point between the thumb and finger and the alternating use of the front and back faces of a playing edge also allows the musician to express his own style and technique of playing, and combination of tone desired.

With a stepped edge 14, plectrum 1 is not flat and can easily be picked up from the table or from inside its holder.

Plectrum 1 has a size of substantially 30 mm from the rounded playing edge 112 to the jagged edge 116, and of substantially 28 mm from the pointed playing edge 114 to edge 118. Plectrum 1 is made of plastic and is suitable for manufacturing, for instance, by plastic injection moulding. Plectrum 1 is also manufactured with thickness of about 1, 0.7 and 0.5 mm and are described as "thick", "medium" and "thin" respectively.

The same numerical reference numbers have been preserved to denote the features that are in common with the first and subsequent embodiments. Alphabet a, b and so on may be added to differentiate similar features in the embodiments.

Figure 4:
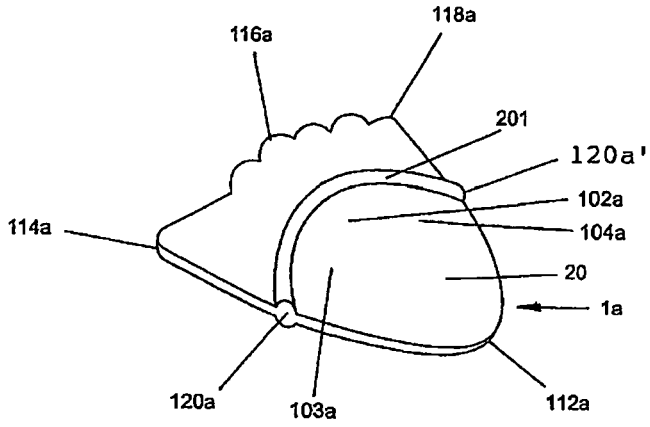
FIGS. 4 and 5 show a perspective and side view respectively of a second embodiment of a plectrum in accordance with this invention.
Figure 5:
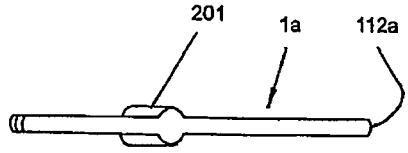

FIG. 4 shows a perspective view of a second embodiment of a plectrum 1*a*. Plectrum 1*a* has a planar body 20 with three corners and an integrally moulded arched ridge 201. The first corner comprises an oval (or melon-seed or teardrop shaped) playing edge 112*a*, which is commonly used for regular play. The second corner comprises a pointed playing edge 114*a*, while the third corner comprises a further pointed playing edge 118*a*. In continuity with 118*a* and on the edge in common with 114*a*, is a jagged or scallop edged playing edge 116*a*. Ridge 201 is curved and extends across plectrum 1*a*, separating the first corner 112*a* from the other two corners 114*a*, 118*a*. The vertex of ridge 201 is oriented away from corner 112*a*. Ridge 201 ends with edges 120*a*, 120*a*' at the sides of plectrum 1*a*. These edges 120*a*, 120*a*' are also suitable as further string engaging edges. FIG. 5 illustrates a side view of plectrum 1*a*.

Figure 6:
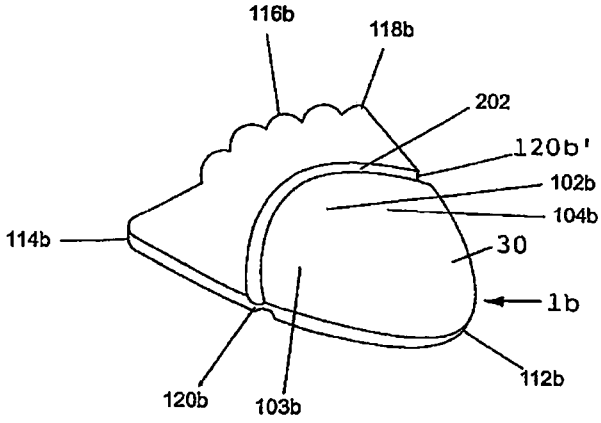
FIGS. 6 and 7 show a perspective and side view respectively of third embodiment of a plectrum in accordance with this invention.
Figure 7:
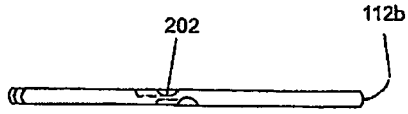

FIG. 6 shows a perspective view of a third embodiment of a plectrum 1*b*. Plectrum 1*b* has a planar body 30 having three corners and an integrally moulded arched groove 202. The first corner comprises an oval (or melon-seed or teardrop) shaped playing edge 112*b*, which is commonly used for regular play. The second corner comprises a pointed playing edge 114*b*, while the third corner comprises a further pointed playing edge 118*b*. In continuity from edge 118*b* and on the edge in common with 114*b*, is a jagged or scallop shaped playing edge 116*b*. The vertex of groove 202 is oriented away from corner 112*b*. Groove 202 ends with edges 120*b*, 120*b*' at the sides of plectrum 1*b*. These edges 120*b*, 120*b*' are also suitable as string engaging edges for playing a stringed instrument. FIG. 7 illustrates a side view of plectrum 1*b*. As illustrated, the grooves 202 on the opposed surfaces of plectrum 1*b* are offset from each other, so that the thickness of plectrum 1*b* is not adversely affected.

Figure 8:
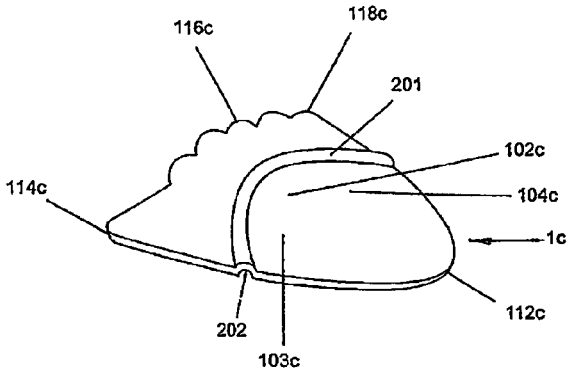
FIGS. 8 and 9 show a perspective and side view respectively of a fourth embodiment of a plectrum in accordance with this invention.
Figure 9:
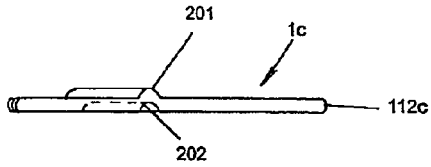

FIG. 8 illustrates a perspective view of a fourth embodiment of a plectrum 1*c*. Plectrum 1*c* has a combination of an arched ridge 201 on one surface and an arched groove 202 on the opposed surface. FIG. 9 illustrates a side view of plectrum 1*c*. The playing edges are 112*c*, 114*c*, 116*c* and 118*c* which are used to produce the edges' own characteristic tone as described above.

Figure 10:
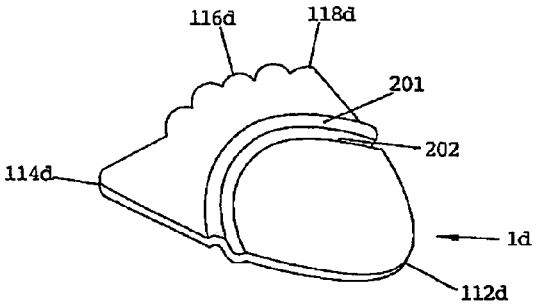
FIGS. 10 and 11 show a perspective and side view respectively of a fifth embodiment of a plectrum in accordance with this invention.
Figure 11:
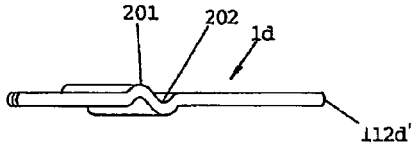

FIG. 10 illustrates a perspective view of a fifth embodiment of a plectrum 1*d*. Plectrum 1*d* has a combination of an arched ridge 201 and an arched groove 202 on the same face. The opposed surface may, optionally, have a similar combination ridge 201 and groove 202. FIG. 11 illustrates a side view of plectrum 1*d*.

While only a few embodiments of a plectrum have been described and illustrated, it is to be understood that changes, modifications and variations could be made to the present invention without departing from the scope of the invention. A variation of the above plectrum is a mirror-image of each embodiment and such mirror-image plectrum is suitable for a left-handed user. Another modification is that the arched ridge 201 or groove 202 extends only substantially across the plectrum 1 and not across the entire width of the plectrum 1. Further, this arched ridge 201 or groove 202 may be formed from a number of discontinuous segments. Other materials, for instance metals, metal alloys or fibre glass may be used. Other manufacturing methods, for instance metal injection moulding or powder metallurgy are also suitable for the manufacture of the plectrum 1.

The invention claimed is:

1. A plectrum for a stringed instrument comprising:

(a) a first portion having a plurality of string engaging means;

(b) a second portion having a further string engaging means;

(c) an integrally formed connection member connecting the first and second portions and formed in the shape of an arc across the plectrum; and (d) a gripping area for a thumb or forefinger of the user including a concave area defined by the arc of the connection member;

wherein the plurality of string engaging means and said further string engaging means are arranged to allow a user to play the stringed instrument by engaging one or more strings of the stringed instrument with one or more of the string engaging means; and said connection member being ridged or stepped.

2. A plectrum according to claim 1, wherein the ridged or stepped member has at least one end which forms a further string engaging surface.

3. A plectrum according to claim 1, wherein the arc of the connection member projects into said first portion.

4. A plectrum according to claim 1, wherein the arc of the connection member projects into said second portion.

5. A plectrum according to claim 1, wherein the first and second portions are planar, with the plane of the first portion displaced relative to that of the second portion by substantially the thickness of the plectrum.

6. A plectrum according to claim 1, wherein said connection member is a curved groove extending substantially across the face of the plectrum.

7. A plectrum according to claim 6, wherein said connection member is a combination of a groove on the first face and a parallel groove on the opposite face of the plectrum forming an S-shaped cross-section in the plectrum.

8. A plectrum according to claim 6, wherein said connection member is a combination of a ridge and a groove abutting each other on at least one face of the plectrum.

9. A plectrum according to claim 1, wherein said connection member comprises a curved ridge extending substantially across a first face of the plectrum and a curved groove extending substantially across the corresponding opposite face of the plectrum.

10. A plectrum according to claim 9, wherein the curved ridge and groove are disposed across the middle of the plectrum and the shapes of the curves are identical.

11. A plectrum according to claim 1, wherein the first portion and the second portion, respectively are substantially flat members.

12. A plectrum according to claim 1, wherein the string engaging means formed on the first or second portions are at least one pointed string engaging edge.

13. A plectrum according to claim 1, wherein the string engaging means formed on the first or second portions are a plurality of jagged or scalloped shaped edges.

14. A plectrum according to claim 1, wherein the string engaging means formed on the first or second portions are a tear-drop shaped string engaging edge.

15. A plectrum according to claim 1, wherein the plectrum is made of materials selected from the group consisting of plastics, metals, metal alloys, fibre glass, and mixtures thereof.

16. A plectrum according to claim 1, wherein said first portion comprises a short pointed string engaging edge in close proximity with a jagged or scalloped shaped edge; wherein said short pointed string engaging edge and said jagged or scalloped shaped edge are shaped and dimensioned for simultaneously engaging a string of a guitar to produce a muted harmonic.

17. A plectrum for a stringed instrument having a first end and a second end, the plectrum comprising:

(a) a first substantially flat member having a plurality of string engaging edges; and (b) a second substantially flat member having a further string engaging edge;

(c) an integrally formed ridged or stepped connection member connecting said first and second members and formed in an arc across the middle of the plectrum; wherein the connection member providing a gripping area for a thumb or forefinger of a user including a concave area defined by the arc of the connection member; and the plurality of string engaging edges and said further string engaging edge are arranged to allow the user to play the stringed instrument by engaging one or more strings of the stringed instrument with one or more of the string engaging edges.

18. A plectrum according to claim 17, wherein the ridged or stepped member has formed at either or both ends a string engaging edge.

19. A plectrum according to claim 17, wherein the plectrum is made of materials selected from the group consisting of plastics, metals, metal alloys and fibre glass.

* * * * *